US008307518B2

(12) United States Patent
Cheung

(10) Patent No.: US 8,307,518 B2
(45) Date of Patent: Nov. 13, 2012

(54) ANTI-THEFT ZIPPER HEAD

(76) Inventor: Po Chu Cheung, Hong Kong (HK)

( * ) Notice: Subject to any disclaimer, the term of this patent is extended or adjusted under 35 U.S.C. 154(b) by 258 days.

(21) Appl. No.: 12/721,561

(22) Filed: Mar. 10, 2010

(65) Prior Publication Data

US 2010/0242236 A1 Sep. 30, 2010

(30) Foreign Application Priority Data

Mar. 25, 2009 (CN) ..... 2009 1 0106185

(51) Int. Cl.
*E05B 67/38* (2006.01)
*A44B 19/30* (2006.01)

(52) U.S. Cl. ..... 24/418; 70/68; 24/386; 24/419; 24/423

(58) Field of Classification Search ..... 70/68; 24/418, 24/419, 421, 422, 423, 424, 425
See application file for complete search history.

(56) References Cited

U.S. PATENT DOCUMENTS 2,185,658 A * 1/1940 Carlile ..... 24/424
2,276,676 A * 3/1942 Sundback ..... 24/424
2,339,350 A * 1/1944 Morin ..... 24/424
2,741,114 A * 4/1956 Poux ..... 70/68
2,785,452 A * 3/1957 Garsson ..... 24/417
4,221,027 A * 9/1980 Oda ..... 24/424
4,262,502 A * 4/1981 Oda ..... 70/68
4,271,689 A * 6/1981 Kasai ..... 70/68
4,951,485 A * 8/1990 Wake ..... 70/68
4,976,121 A * 12/1990 Wake ..... 70/68
5,167,052 A * 12/1992 Aoki et al. ..... 24/421
5,321,871 A * 6/1994 Oda ..... 24/418
7,979,964 B2 * 7/2011 Jans ..... 24/386
2005/0109072 A1 * 5/2005 Ling et al. ..... 70/68

* cited by examiner

*Primary Examiner* — Robert J Sandy
*Assistant Examiner* — Michael Lee

(57) ABSTRACT

An anti-theft zipper head includes a head member and a handle. The head member includes a zipper groove for engaging a zipper. The handle is connected with the head member. The head member further includes an elastic piece. The elastic piece is configured for engaging the zipper and thereby confining the movement of the head member on the zipper. The handle includes a push switch. The push switch is configured to control the elastic piece to extend into the zipper groove so as to engage the zipper, or to withdraw from the zipper groove so as to be disengaged with the zipper.

17 Claims, 14 Drawing Sheets

ANTI-THEFT ZIPPER HEAD

CROSS-REFERENCE TO RELATED APPLICATIONS

This application claims the benefit of Chinese Patent Application No. 200910106185.3, filed on Mar. 25, 2009; the contents of which is hereby incorporated by reference.

FIELD OF THE PATENT APPLICATION

The present invention generally relates to a zipper and more particularly to a zipper head that is secure and convenient to use.

BACKGROUND

Zippers have been widely used today while the zipper heads of most zippers do not have any anti-theft capabilities. For these zippers, external locks have to be added to prevent items enclosed by the zippers from being stolen. For example, suit cases usually need a password lock or an external lock to be installed thereto. As for regular handbags, waist-bags, and backpacks installed with conventional zippers, they all have such disadvantage so that almost anyone can easily open the zippers and steal the items inside.

SUMMARY

The present patent application is directed to an anti-theft zipper head. In one aspect, the anti-theft zipper head includes a head member, the head member including a zipper groove for engaging a zipper; and a handle connected with the head member. The head member further includes an elastic piece, the elastic piece being configured for engaging the zipper and thereby confining the movement of the head member on the zipper. The handle includes a push switch, the push switch being configured to control the elastic piece to extend into the zipper groove so as to engage the zipper, or to withdraw from the zipper groove so as to be disengaged with the zipper.

The push switch may be connected with the elastic piece through a cord. The elastic piece may be rotatably disposed in the head member and having a first position of extending into the zipper groove or a second position of being outside of the zipper groove. The push switch may be a sliding block elastically disposed on the handle and an end of the elastic piece may have an inclined surface. The handle may further include a password lock, the password lock being configured to lock or unlock the push switch.

The anti-theft zipper head may further include a subordinate head detachably connected with the handle, a mount member being configured on the subordinate head, a through hole being formed in the mounting member, a bolt unit compatible with the through hole being configured in the handle, an actuator being formed on the push switch, the actuator being connected with the bolt unit and configured for drive the bolt unit to move in or out of the through hole so as to lock or unlock the subordinate head.

The bolt unit may include a bolt member and a push member. The bolt member is elastically connected to the handle. A bolt compatible with the through hole is formed on the bolt member. The push member is installed on and covering the bolt. The actuator is pushed against the push member.

A spring may be disposed at the bottom of the bolt member. The spring is configured to elastically connect the bolt member to the handle.

DETAILED DESCRIPTION

Reference will now be made in detail to a preferred embodiment of the anti-theft zipper head disclosed in the present patent application, examples of which are also provided in the following description. Exemplary embodiments of the anti-theft zipper head disclosed in the present patent application are described in detail, although it will be apparent to those skilled in the relevant art that some features that are not particularly important to an understanding of the anti-theft zipper head may not be shown for the sake of clarity.

Furthermore, it should be understood that the anti-theft zipper head disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 1A:
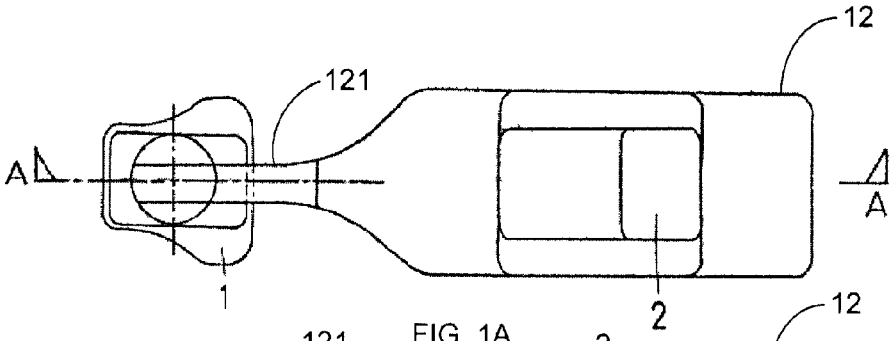
FIG. 1A is top view of an anti-theft zipper head according to an embodiment of the present patent application.
Figure 1B:
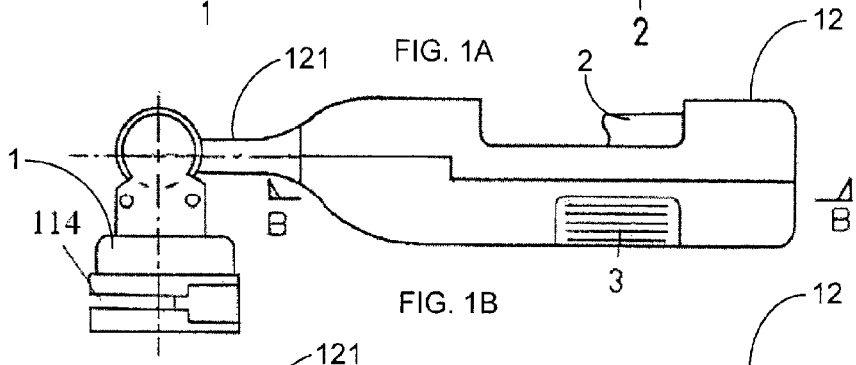
FIG. 1B is a front view of the anti-theft zipper head depicted in FIG. 1A.
Figure 1C:
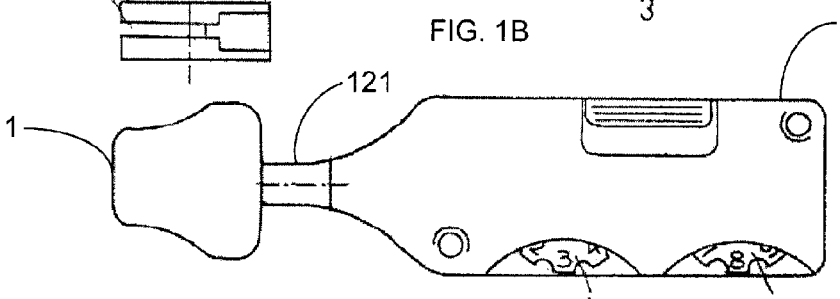
FIG. 1C is a bottom view of the anti-theft zipper head depicted in FIG. 1A.
Figure 1D:
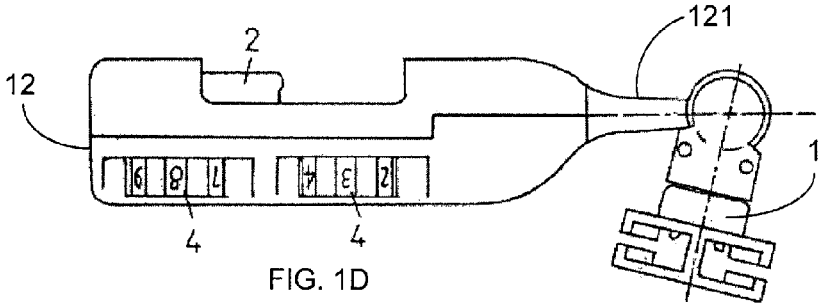
FIG. 1D is a rear view of the anti-theft zipper head depicted in FIG. 1A.
Figure 1E:
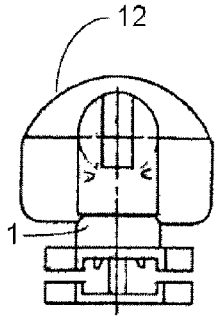
FIG. 1E is a side view of the anti-theft zipper head depicted in FIG. 1A.
Figure 1F:
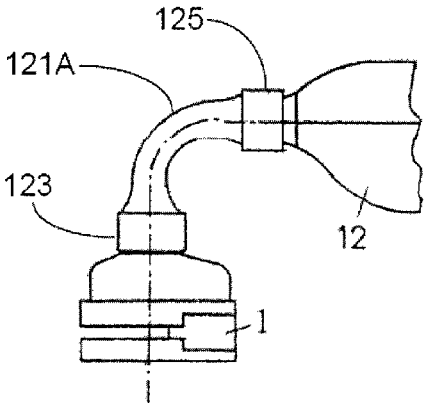
FIG. 1F illustrates a connection between a head member and a handle in the anti-theft zipper head depicted in FIG. 1A.
Figure 1G:
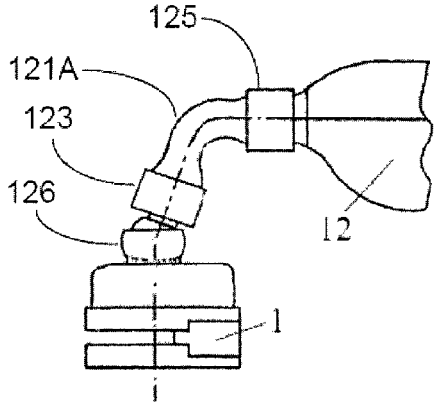
FIG. 1G illustrates an alternative connection between a head member and a handle in the anti-theft zipper head depicted in FIG. 1A.
Figure 1H:
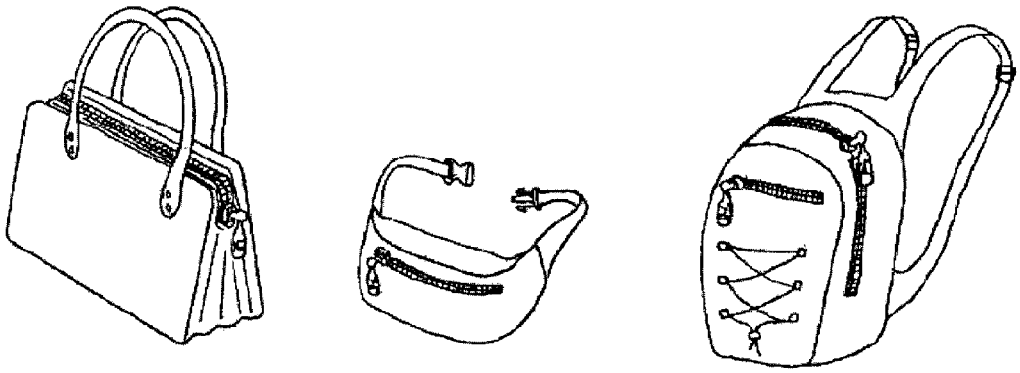
FIG. 1H illustrates a handbag, a waist bag and a backpack having the anti-theft zipper head depicted in FIG. 1A.

FIG. 1A is top view of an anti-theft zipper head according to an embodiment of the present patent application. FIG. 1B is a front view of the anti-theft zipper head. FIG. 1C is a bottom view of the anti-theft zipper head. FIG. 1D is a rear view of the anti-theft zipper head. FIG. 1E is a side view of the anti-theft zipper head. Referring to FIGS. 1A-1E, the anti-theft zipper head includes a head member 1 and a handle 12 connected to the head member 1 through a connection 121. FIG. 1F illustrates a connection between the head member 1 and a handle 12. FIG. 1G illustrates an alternative connection between the head member 1 and a handle 12. FIG. 1H illustrates a handbag, a waist bag and a backpack having the anti-theft zipper head. Referring to FIG. 1F, two sleeves 123 and 125 are respectively disposed on the two ends of the flexible hose 121A. Another sleeve 123A (as shown in FIG. 2M) is disposed on the top of the head member 1 and configured to be compatible with the sleeve 123 at one end of the flexible hose 121A. Yet another sleeve 125A (as shown in FIG. 2M) is disposed on an end of the handle 12 and configured to be compatible with the sleeve 125 at the other end of the flexible hose 121A. Referring to FIG. 1G, as an alternative way of connecting the head member 1 and the handle 12, a connecting head 126 is disposed on the top of the head member 1 and connected to the sleeve 123 at the end of the flexible hose 121A.

Referring to FIG. 1B, a zipper groove 114 is configured on the head member 1 and for engaging a zipper. A push switch 2 is configured on the handle 12 and for confining the position of the head member 1 on the zipper so that the head member 1 can only move toward the direction to close the zipper and can not move toward the direction to open the zipper. Referring to FIG. 1C and FIG. 1D, the push switch 2 is further configured to be locked by at least a password lock so as to in turn lock the zipper head. In this embodiment, there are two password locks.

Figure 2A:
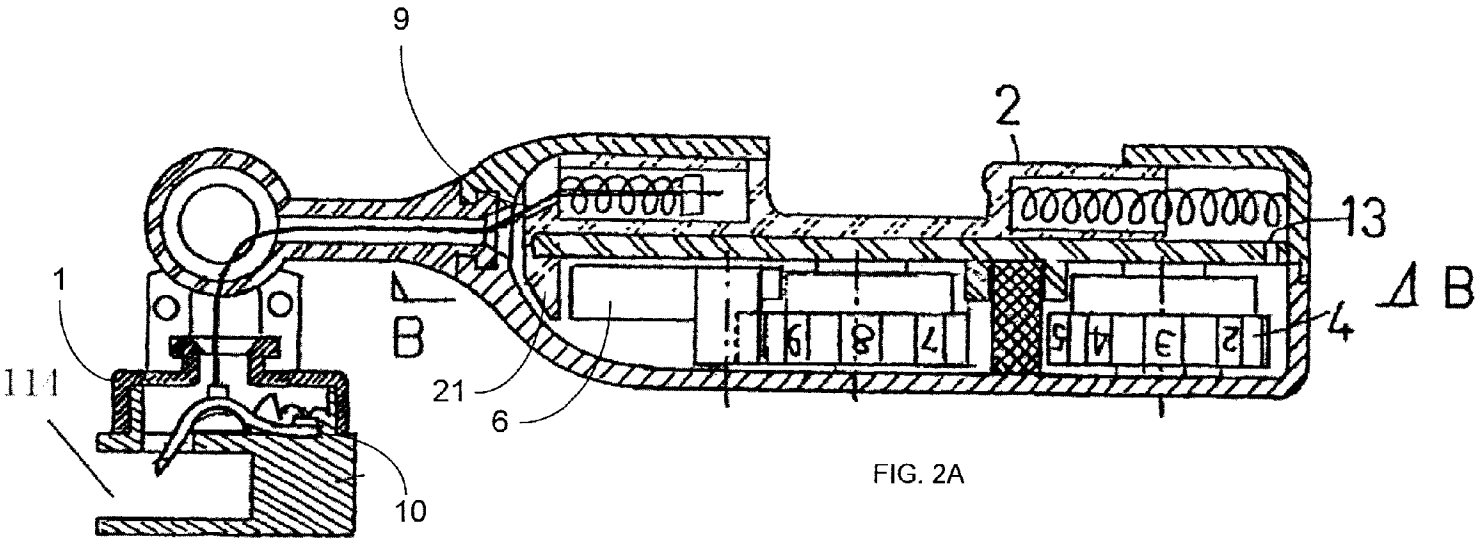
FIG. 2A is a cross-sectional view of the zipper head depicted in FIG. 1A taken along the line A-A in FIG. 1A when an elastic piece is locked.
Figure 2B:
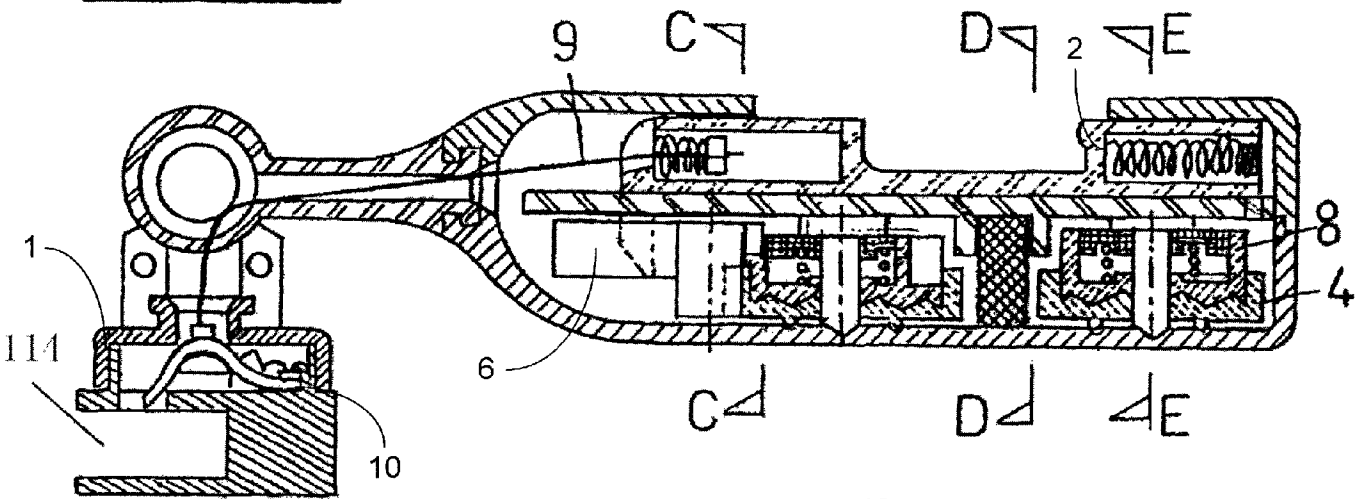
FIG. 2B is a cross-sectional view of the zipper head depicted in FIG. 1A taken along the line A-A in FIG. 1A when an elastic piece is unlocked.
Figure 2C:
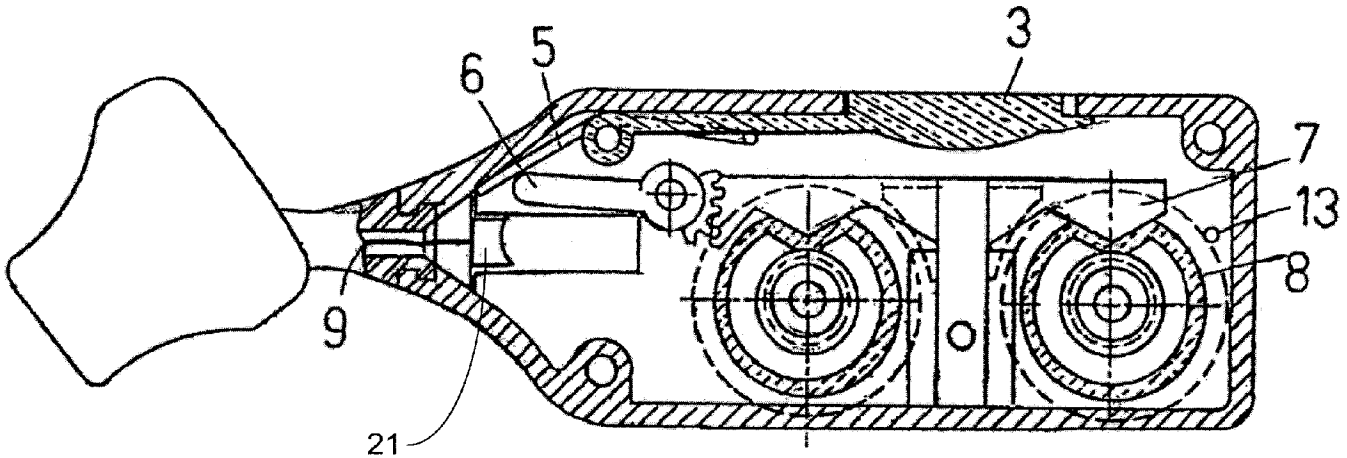
FIG. 2C is a cross-sectional view of the zipper head depicted in FIG. 2A taken along the line B-B in FIG. 2A when a password lock is unlocked.
Figure 2D:
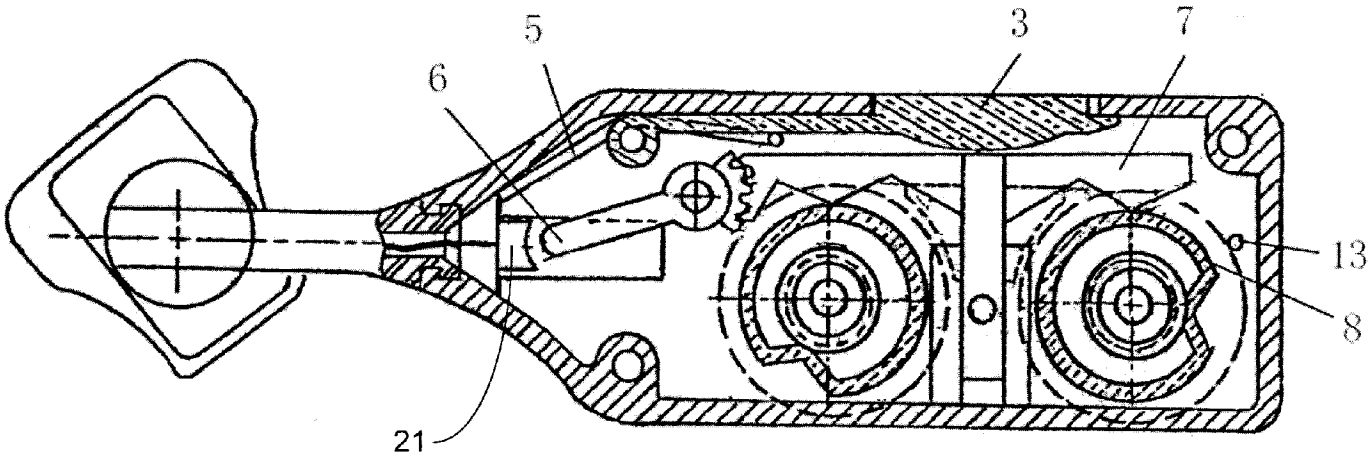
FIG. 2D is a cross-sectional view of the zipper head depicted in FIG. 2A taken along the line B-B in FIG. 2A when a password lock locks a push switch.
Figure 2E:
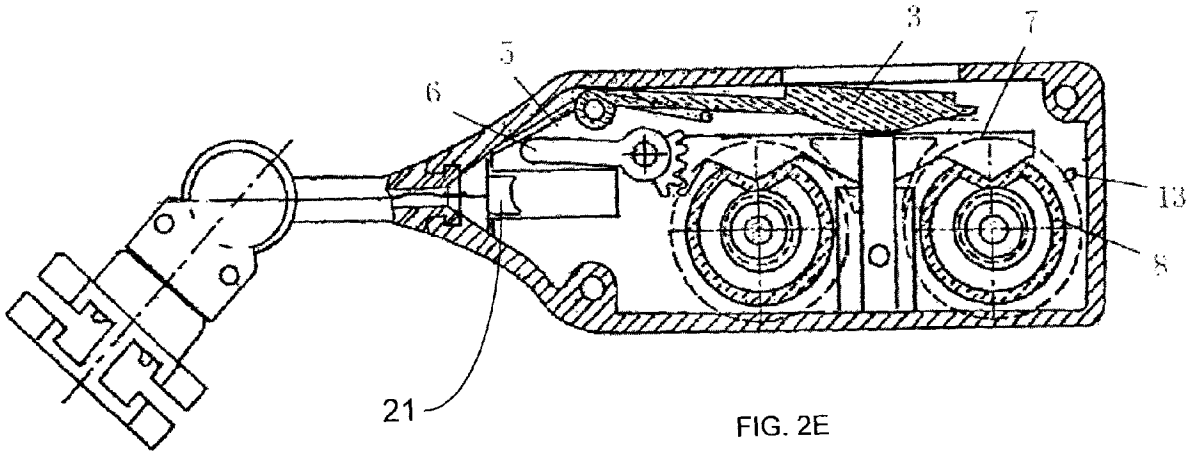
FIG. 2E is a cross-sectional view of the zipper head depicted in FIG. 2A taken along the line B-B in FIG. 2A when a password lock unlocks a push switch.
Figure 2H:
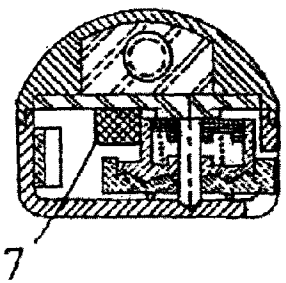
FIG. 2H is a cross-sectional view of the zipper head depicted in FIG. 2B taken along the line E-E in FIG. 2B.
Figure 2G:
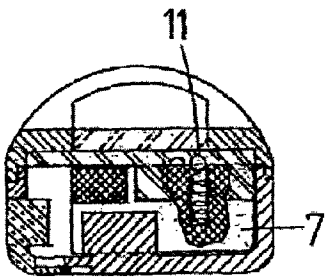
FIG. 2G is a cross-sectional view of the zipper head depicted in FIG. 2B taken along the line D-D in FIG. 2B.
Figure 2F:
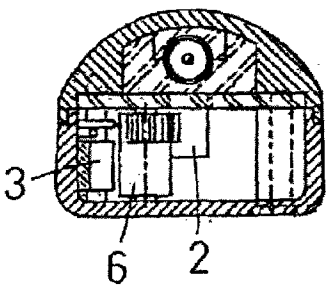
FIG. 2F is a cross-sectional view of the zipper head depicted in FIG. 2B taken along the line C-C in FIG. 2B.
Figure 2J:
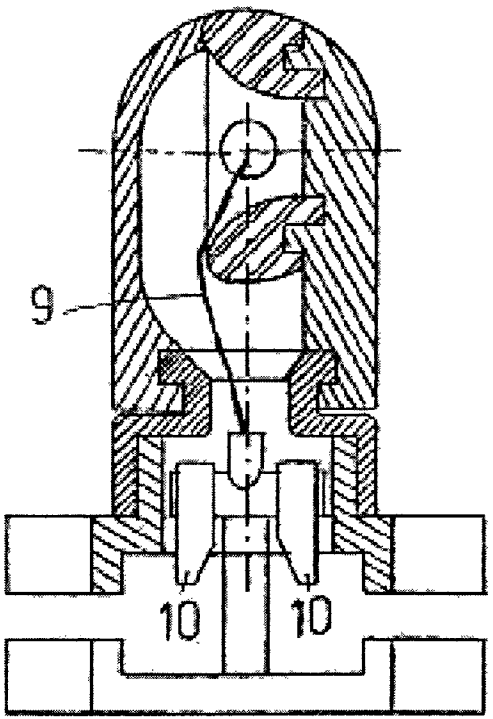
FIG. 2J is a cross-sectional view of the zipper head depicted in FIG. 2I taken along the line I-I in FIG. 2I.
Figure 2I:
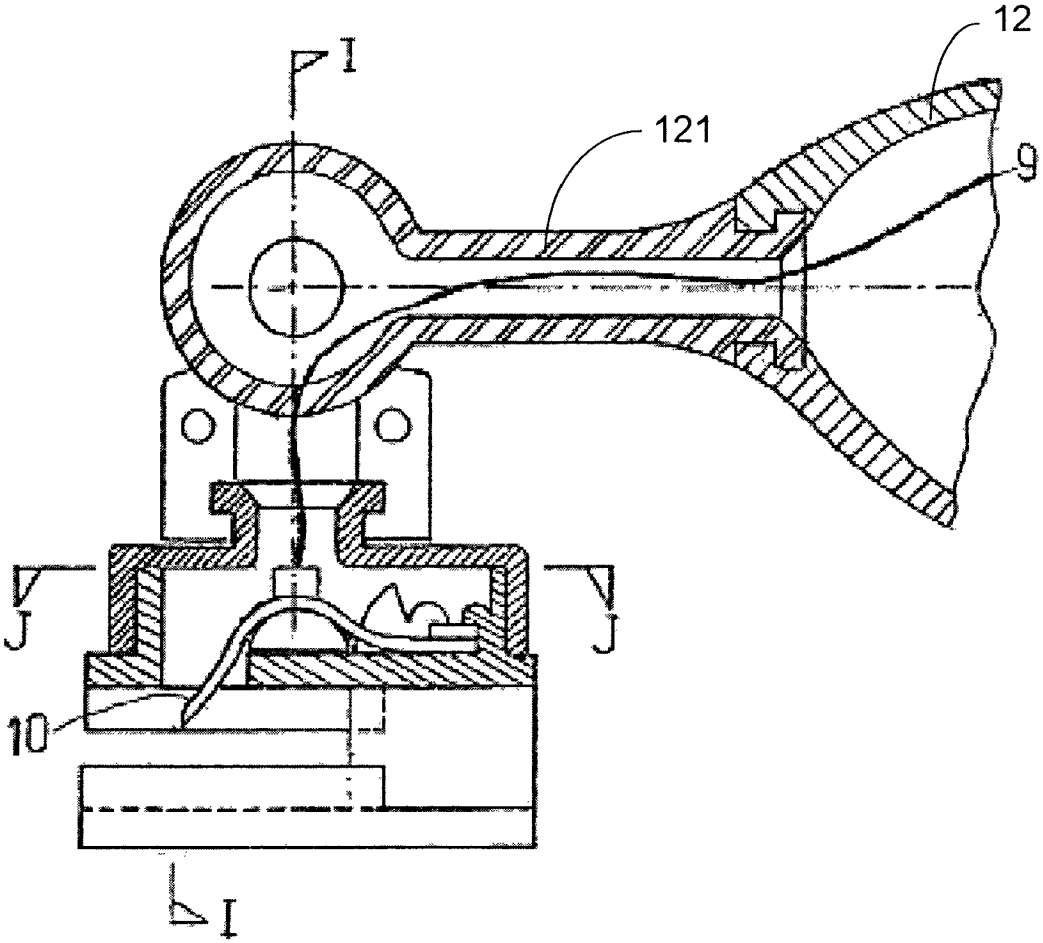
FIG. 2I is a partial magnified view of the zipper head depicted in FIG. 2B.
Figure 2K:
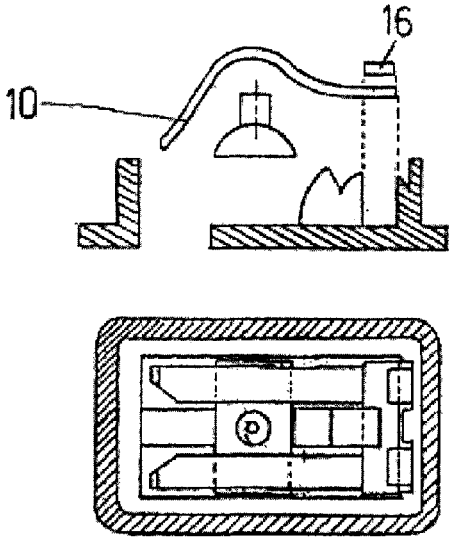
FIG. 2K is a cross-sectional view of the zipper head depicted in FIG. 2I taken along the line J-J in FIG. 2I.
Figure 2L:
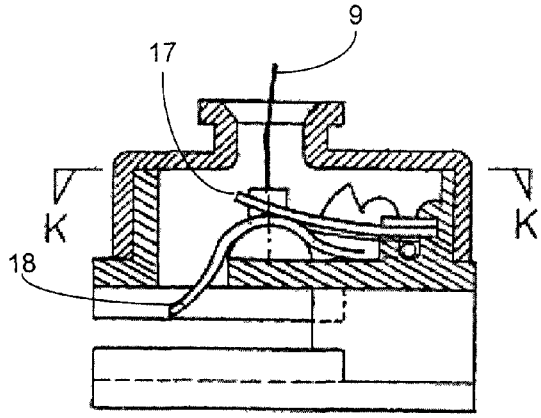
FIG. 2L illustrates the zipper head depicted in FIG. 2I when another type of elastic piece assembly is used, wherein the elastic piece assembly includes a spring and a claw.
Figure 2M:
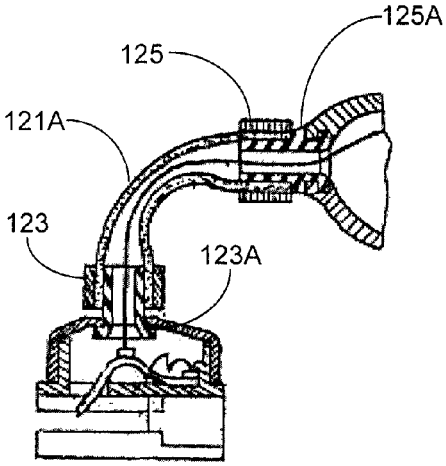
FIG. 2M is a cross-sectional view of the zipper head depicted in FIG. 1F.
Figure 2N:
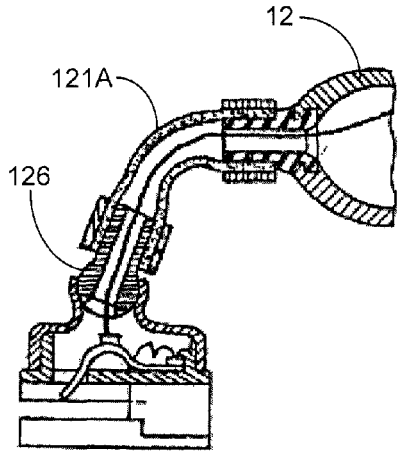
FIG. 2N is a cross-sectional view of the zipper head depicted in FIG. 1G.
Figure 2O:
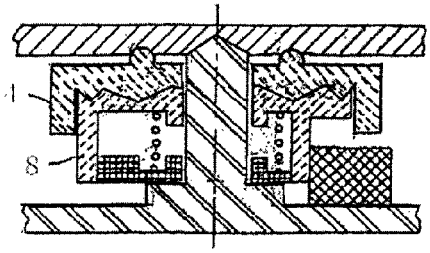
FIG. 2O illustrates a password lock of the zipper head depicted in FIG. 2A when the password lock is working properly.
Figure 2P:
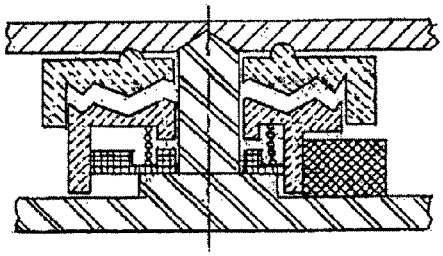
FIG. 2P illustrates the password lock depicted in FIG. 2O when a new password is set for the password lock.
Figure 2Q:
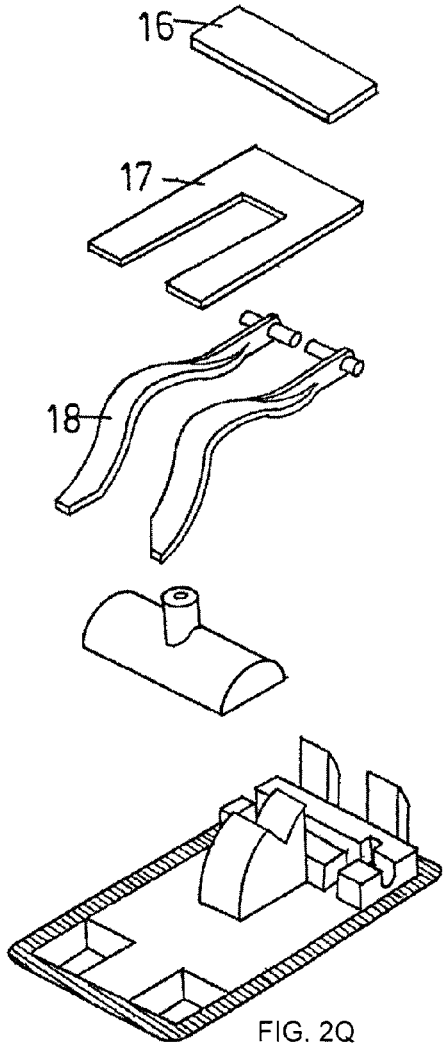
FIG. 2Q is an exploded view of the elastic piece assembly depicted in FIG. 2I.
Figure 2R:
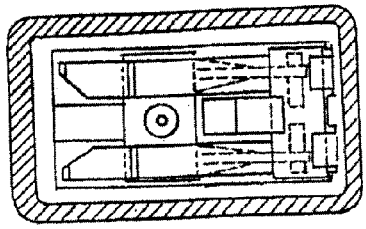
FIG. 2R is a cross-sectional view of the zipper head depicted in FIG. 2L taken along the line K-K in FIG. 2L.
Figure 3:
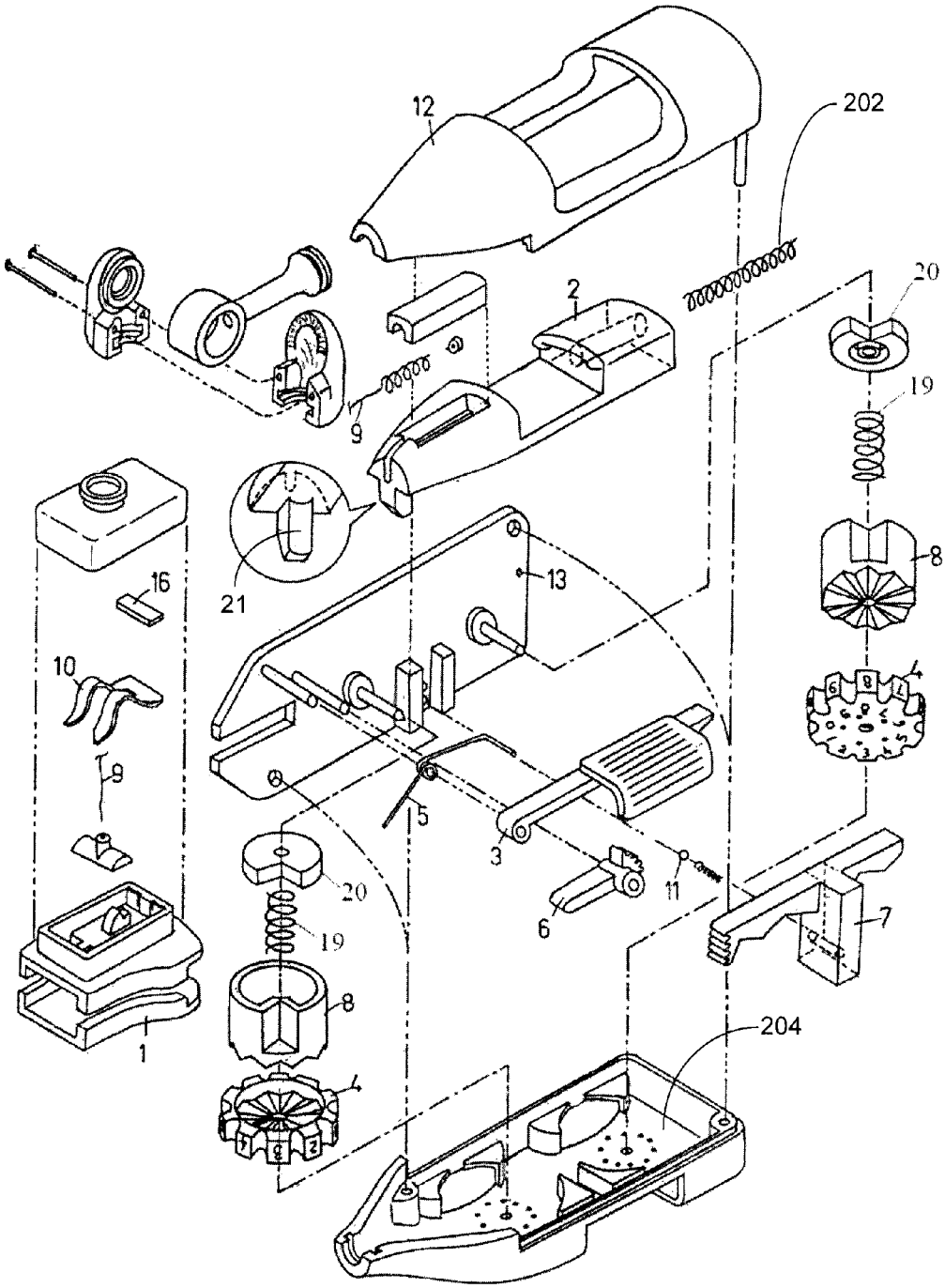
FIG. 3 is an exploded view of the zipper head depicted in FIG. 1A.

FIG. 2A is a cross-sectional view of the zipper head depicted in FIG. 1A taken along the line A-A in FIG. 1A when an elastic piece is locked. FIG. 2B is a cross-sectional view of the zipper head depicted in FIG. 1A taken along the line A-A in FIG. 1A when the elastic piece is unlocked. FIG. 2C is a cross-sectional view of the zipper head depicted in FIG. 2A taken along the line B-B in FIG. 2A when a password lock is unlocked. FIG. 2D is a cross-sectional view of the zipper head depicted in FIG. 2A taken along the line B-B in FIG. 2A when a password lock locks a push switch. FIG. 2E is a cross-sectional view of the zipper head depicted in FIG. 2A taken along the line B-B in FIG. 2A when a password lock unlocks a push switch. FIG. 2F is a cross-sectional view of the zipper head depicted in FIG. 2B taken along the line C-C in FIG. 2B. FIG. 2G is a cross-sectional view of the zipper head depicted in FIG. 2B taken along the line D-D in FIG. 2B. FIG. 2H is a cross-sectional view of the zipper head depicted in FIG. 2B taken along the line E-E in FIG. 2B. FIG. 2I is a partial magnified view of the zipper head depicted in FIG. 2B. FIG. 2J is a cross-sectional view of the zipper head depicted in FIG. 2I taken along the line I-I in FIG. 2I. FIG. 2K is a cross-sectional view of the zipper head depicted in FIG. 2I taken along the line J-J in FIG. 2I. FIG. 2L illustrates the zipper head depicted in FIG. 2I when another type of elastic piece assembly is used, wherein the elastic piece assembly includes a spring and a claw. FIG. 2M is a cross-sectional view of the zipper head depicted in FIG. 1F. FIG. 2N is a cross-sectional view of the zipper head depicted in FIG. 1G. FIG. 2O illustrates a password lock of the zipper head depicted in FIG. 2A when the password lock is working properly. FIG. 2P illustrates the password lock depicted in FIG. 2O when a new password is set for the password lock. FIG. 2Q is an exploded view of the elastic piece assembly depicted in FIG. 2I. FIG. 2R is a cross-sectional view of the zipper head depicted in FIG. 2L taken along the line K-K in FIG. 2L. FIG. 3 is an exploded view of the zipper head depicted in FIG. 1A. Referring to FIGS. 2A-2R and FIG. 3, the elastic piece 10 is disposed inside the head member 1. The elastic piece 10 may stay in a first position and a second position in the head member 1. The first position is inside the zipper groove 114 and the second position is outside of the zipper groove 114. When the elastic piece 10 is at the first position and inside the zipper groove 114, the elastic piece 10 is inserted into the zipper teeth so as to confine the movement of the head member 1. In this embodiment, an end of the elastic piece 10 is designed to have an inclined surface. In the direction to close the zipper, the inclined end is parallel with the zipper so that the head member 1 can be moved in this direction. In the direction to open the zipper, however, the inclined end will go up, insert into the zipper teeth and become stuck therewith so that the head member 1 can not move in this direction. When the elastic piece 10 is at the second position and outside of the zipper groove 114, the head member 1 can move on the zipper freely. In this embodiment, the push switch 2 is configured to set the elastic piece 10 to be at the first position or the second position so as to lock or unlock the elastic piece 10. To realize the control of the elastic piece 10 with the push switch 2, the push switch 2 is connected with the elastic piece 10 through a cord 9. When the push switch 2 moves on the handle 12, the elastic piece 10 is pulled by the cord 9. In this embodiment, the cord 9 may be a stainless steel wire or a nylon cord.

Referring to FIG. 3, in this embodiment, the push switch 2 is simply a sliding block. The elastic piece 10 is a curved spring piece. The elastic piece 10 is disposed in the head member 1 and a tablet 16 is disposed on the elastic piece 10 so as to stabilize the periphery of the elastic piece 10 and prevent the elastic piece from turning up or being dislocated when applied with force. The push switch 2 is configured to drive the elastic piece 10 through the cord 9. To generate a spring force when the push switch 2 is pushed, a spring 202 is configured in the push switch 2 so that the push switch 2 and the handle 12 are elastically connected. The password lock includes a dial wheel 4, a gear 8, a spring 19, a washer 20, a locking rod 6, a T-shaped sliding rod 7, a spring 5, and an unlocking switch 3. The washer 20, the spring 19, the gear 8, and the dial wheel 4 are coaxially installed on an installation board 204 inside the handle 12. The locking rod 6, the T-shaped sliding rod 7, the spring 5 and the unlocking switch 3 are also installed on the installation board 204. The dial wheel 4, the gear 8, the spring 19, the washer 20, the locking rod 6, the T-shaped sliding rod 7, the spring 5, and the unlocking switch 3 are mechanically connected and configured to actuate one another. A protruding portion is extended downwards under the bottom of the push switch 2. The T-shaped sliding rod 7 is configured to drive the gear set formed by the washer 20, the spring 19, the gear 8 and the dial wheel 4 to actuate the locking rod 6 to obstruct the displacement of the protruding portion 21 at the bottom of the push switch 2 or to give free way for the displacement of the protruding portion 21 so that the push switch 2 can be blocked or unblocked and the password lock can be unlocked or locked. In operation, if two correct codes are input through the dial wheel 4, the password lock will be unlocked; if any one of the two codes is wrong, the password lock will be locked.

The password lock may also be unlocked by pushing the unlocking switch 3. If the unlocking switch 3 is pushed for a long time and then the dial wheel is turned by a strong force, a new password code may be set, as illustrated in FIG. 2O and FIG. 2P.

The spring 5 pushes the unlocking switch 3 to be in touch with a housing of the handle 12 so as to avoid interfering with the working of the T-shaped sliding rod 7. The locking rod 6 may swing left and right so as to obstruct the displacement of the protruding portion 21 at the bottom of the push switch 2 or to give free way for the displacement of the protruding portion 21. A steel ball 11 is disposed in a spring and, along with the spring, disposed in the T-shaped sliding rod 7 to prevent the sliding rod 7 from shifting into a wrong position while under a strong shock. In this embodiment, through holes are formed on the installation board 204 so as to prevent sealed air interfering with the opening and closing of the push switch 2.

Figure 4A:
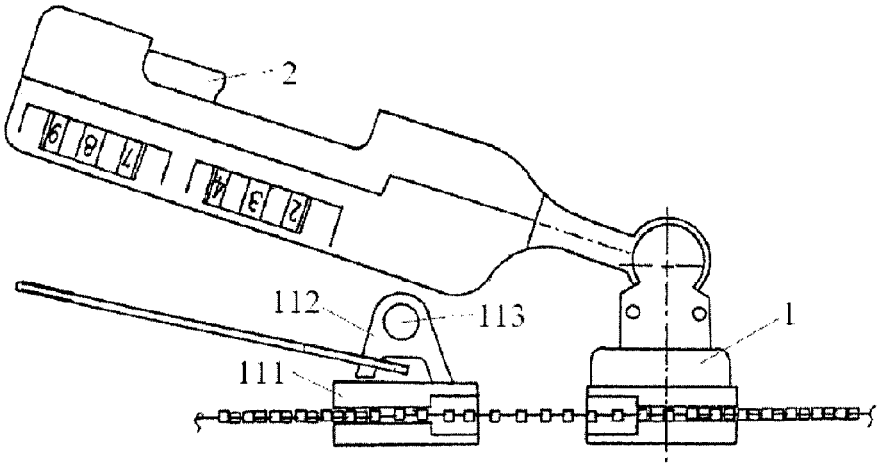
FIG. 4A illustrates a zipper head according to another embodiment of the present patent application.
Figure 4B:
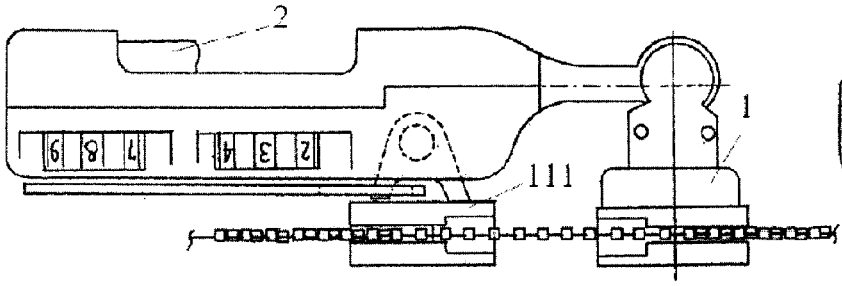
FIG. 4B illustrates the zipper head depicted in FIG. 4A when the subordinate head is connected to the handle.
Figure 4D:
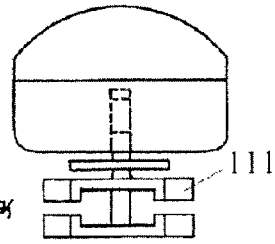
FIG. 4D is a side view of the zipper head depicted in FIG. 4B.
Figure 4C:
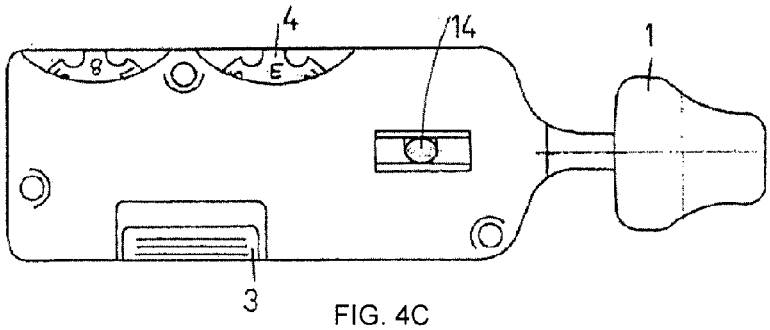
FIG. 4C is a bottom view of the zipper head depicted in FIG. 4A.
Figure 5A:
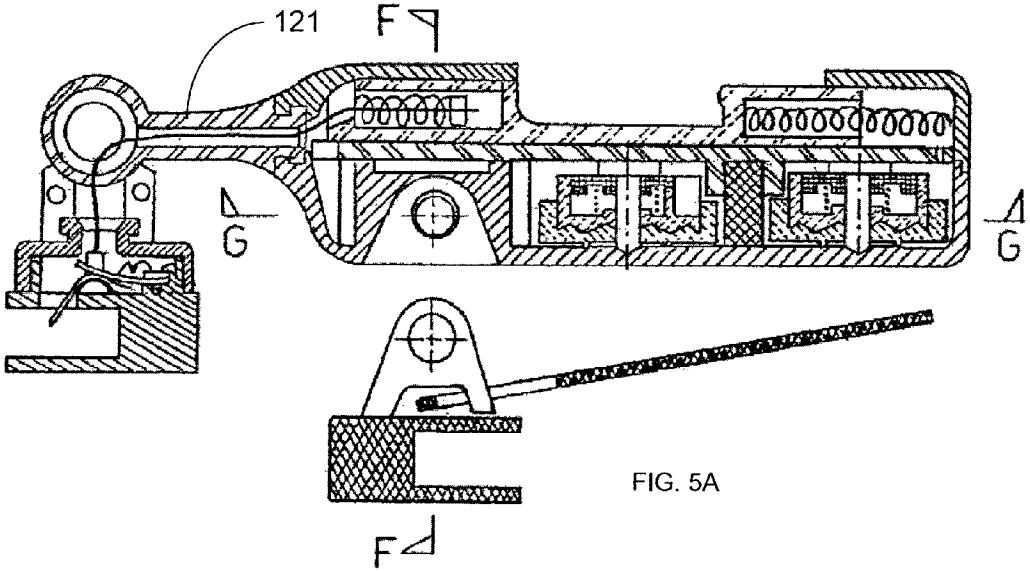
FIG. 5A is a cross-sectional view of the zipper head depicted in FIG. 4A.
Figure 5B:
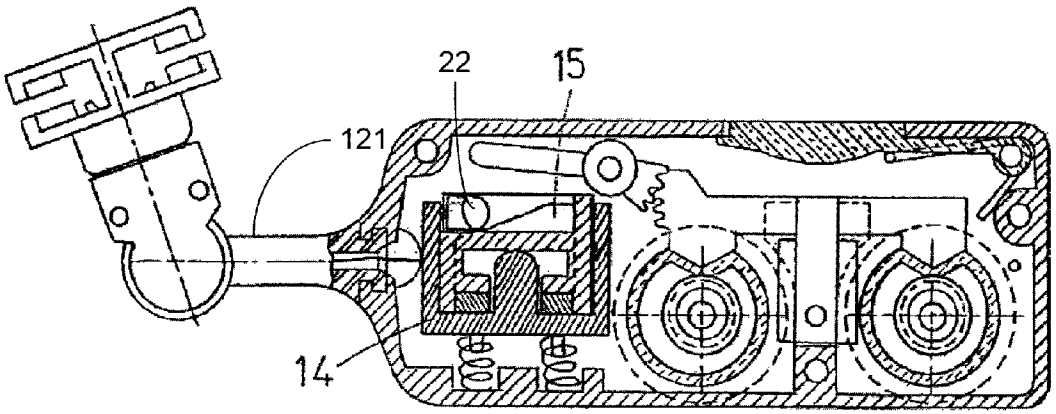
FIG. 5B is a cross-sectional view of the zipper head depicted in FIG. 5A taken along the line G-G when the subordinate head is not connected to the handle.
Figure 5C:
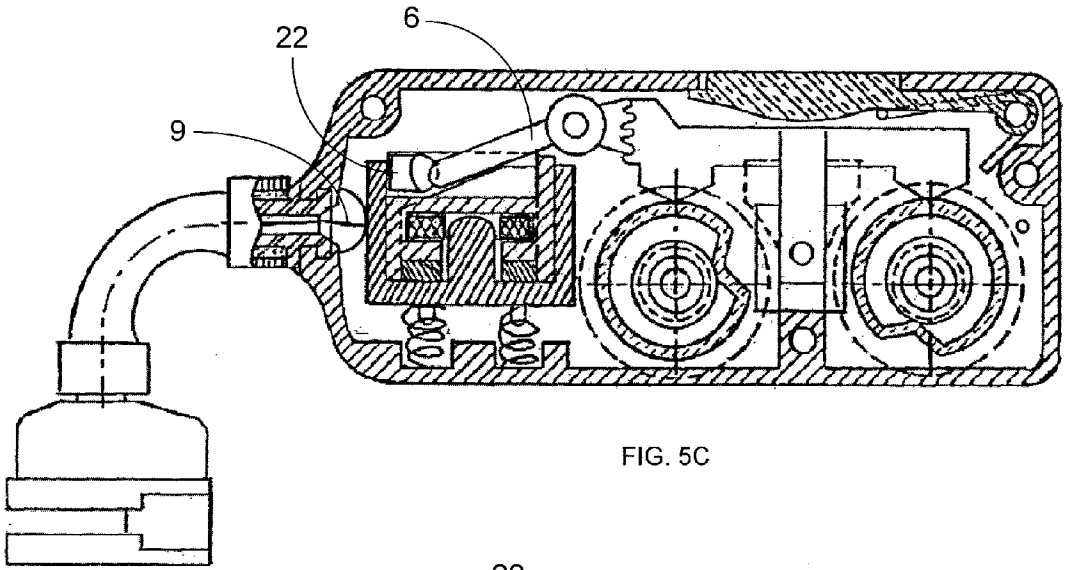
FIG. 5C is a cross-sectional view of the zipper head depicted in FIG. 5A taken along the line G-G when the subordinate head is connected to the handle and the password lock is locked.
Figure 5D:
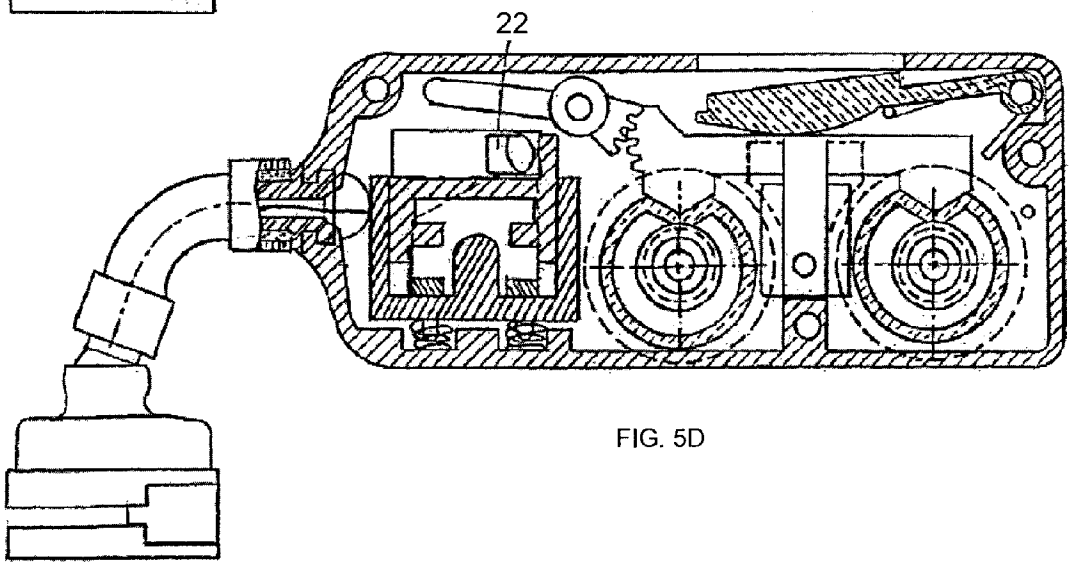
FIG. 5D is a cross-sectional view of the zipper head depicted in FIG. 5A taken along the line G-G when the subordinate head is unlocked through the push switch.
Figure 5E:
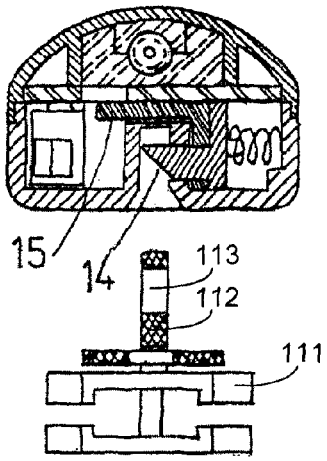
FIG. 5E is a cross-sectional view of the zipper head depicted in FIG. 5A taken along the line F-F when the subordinate head is not connected to the handle.
Figure 5G:
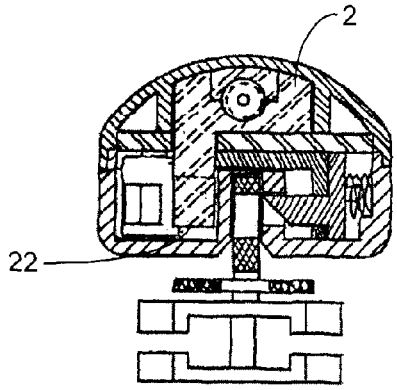
FIG. 5G is a cross-sectional view of the zipper head depicted in FIG. 5A taken along the line F-F when the subordinate head is connected to the handle and unlocked by the push switch.
Figure 5F:
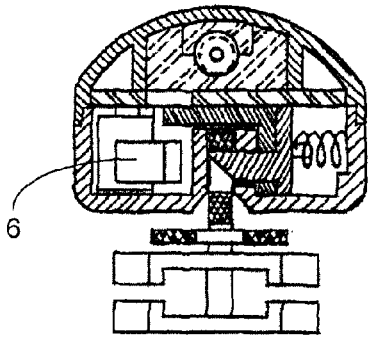
FIG. 5F is a cross-sectional view of the zipper head depicted in FIG. 5A taken along the line F-F when the subordinate head is connected to the handle and locked by the push switch.
Figure 5H:
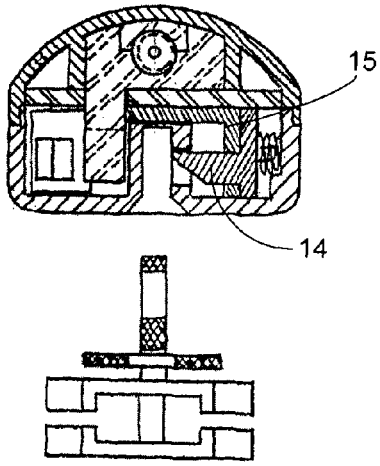
FIG. 5H is a cross-sectional view of the zipper head depicted in FIG. 5A taken along the line F-F when the subordinate head is separated from the handle.
Figure 6:
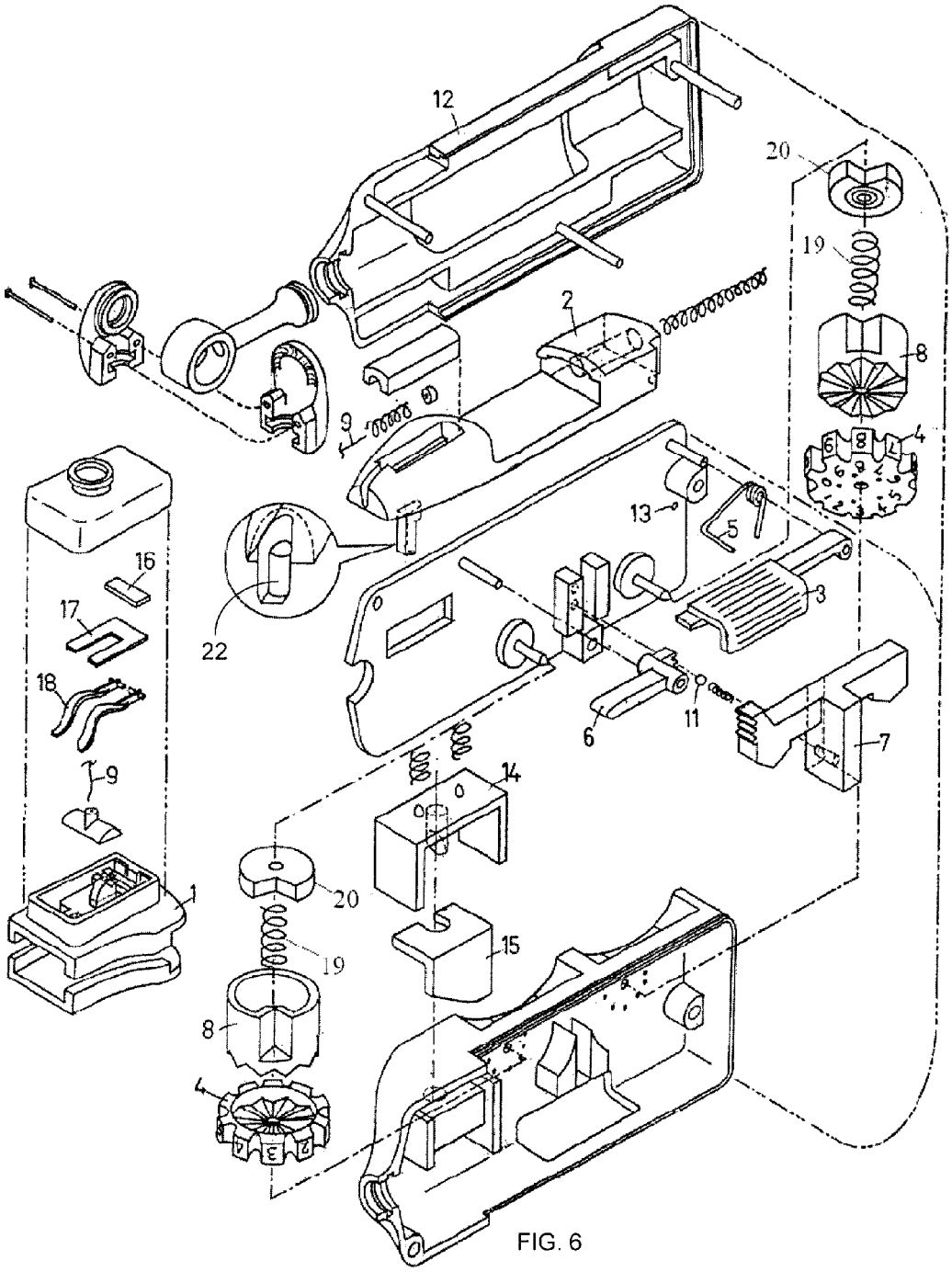
FIG. 6 is an exploded view of the zipper head depicted in FIG. 4A.

FIG. 4A illustrates a zipper head according to another embodiment of the present patent application. FIG. 4B illustrates the zipper head depicted in FIG. 4A when the subordinate head is connected to the handle. FIG. 4C is a bottom view of the zipper head depicted in FIG. 4A. FIG. 4D is a side view of the zipper head depicted in FIG. 4B. FIG. 5A is a cross-sectional view of the zipper head depicted in FIG. 4A. FIG. 5B is a cross-sectional view of the zipper head depicted in FIG. 5A taken along the line G-G when the subordinate head is not connected to the handle. FIG. 5C is a cross-sectional view of the zipper head depicted in FIG. 5A taken along the line G-G when the subordinate head is connected to the handle and the password lock is locked. FIG. 5D is a cross-sectional view of the zipper head depicted in FIG. 5A taken along the line G-G when the subordinate head is unlocked through the push switch. FIG. 5E is a cross-sectional view of the zipper head depicted in FIG. 5A taken along the line F-F when the subordinate head is not connected to the handle. FIG. 5F is a cross-sectional view of the zipper head depicted in FIG. 5A taken along the line F-F when the subordinate head is connected to the handle and locked by the push switch. FIG. 5G is a cross-sectional view of the zipper head depicted in FIG. 5A taken along the line F-F when the subordinate head is connected to the handle and unlocked by the push switch. FIG. 5H is a cross-sectional view of the zipper head depicted in FIG. 5A taken along the line F-F when the subordinate head is separated from the handle. FIG. 6 is an exploded view of the zipper head depicted in FIG. 4A. Referring to FIGS. 4A-4D, 5A-5H and 6, compared to the previous embodiment, in this embodiment, a subordinate head 111 is added. The subordinate head 111 may be detachably connected with the handle 12. More specifically, a mount member 112 is configured on the subordinate head 111 and a through hole 113 is formed in the mounting member 112. A bolt unit compatible with the through hole 113 is configured in the handle 12. An actuator 22 is formed at the bottom of the push switch 2 extending and protruding downwardly. The actuator 22 is connected with and pushed against the bolt unit, and configured for drive the bolt unit to move in or out of the through hole 113 so as to lock or unlock the subordinate head 111.

The bolt unit includes a bolt member 14 and a push member 15. The bolt member 14 may be designed to have a "W" shape and elastically connected to the installation board in the handle 12. The push member 15 may be designed to have an "L" shape. A bolt compatible with the through hole 113 is formed on the W-shaped bolt member 14. The L-shaped push member 15 is installed on and covering the bolt. The actuator 22 is pushed against an inclined surface of the bottom of the push member 15 so as to push the L-shaped push member 15 in the process of pushing the push switch 2, to further push the W-shaped bolt member 14 and to drive the bolt to move in or out of the through hole 113.

The W-shaped bolt member 14 may be elastically connected to the installation board through two springs disposed at the bottom of the W-shaped bolt member 14. The claw 18 in this embodiment may be a strengthened metal piece, which is hard and not easy to be broken. In this embodiment, the tablet 16, the spring 17 and the claw 18 are sequentially placed one on top of another.

In the above embodiments, by turning one or two dial wheels 4, the push switch 2 can be locked. Then, when the dial wheels 4 are turned to the correct codes, a push at the unlocking switch 3 may trigger the push switch 2. When the password lock is unlocked, a long push at the unlocking switch 3 will make the T-shaped sliding rod 7 push the gear 8 so that the gear 8 is not movable. Afterwards, turning the dial wheel 4 by strong force will disengage the gear 8 and the dial wheels 4 so that the dial wheels 4 may be moved freely, as illustrated by FIG. 2O and FIG. 2P, and a new password code may be set. After the new password is set, the unlocking switch 3 may be released so that the gear 8 and the dial wheel 4 are engaged with each other and may turn together as one unit.

While the present patent application has been shown and described with particular references to a number of embodiments thereof, it should be noted that various other changes or modifications may be made without departing from the scope of the present invention.

What is claimed is:

1. An anti-theft zipper head comprising:

a head member, the head member comprising a zipper groove for engaging a zipper; and a handle connected with the head member; wherein:

the head member further comprises an elastic piece, the elastic piece being configured for engaging the zipper and thereby confining the movement of the head member on the zipper; and the handle comprises a push switch, the push switch being configured to control the elastic piece to extend into the zipper groove so as to engage the zipper, or to withdraw from the zipper groove so as to be disengaged with the zipper, and the push switch is connected with the elastic piece through a cord.

2. The anti-theft zipper head of claim 1, wherein the elastic piece is rotatably disposed in the head member and having a first position of extending into the zipper groove or a second position of being outside of the zipper groove.

3. The anti-theft zipper head of claim 1, wherein the push switch is a sliding block elastically disposed on the handle and an end of the elastic piece has an inclined surface.

4. The anti-theft zipper head of claim 1 further comprising a subordinate head detachably connected with the handle, a mount member being configured on the subordinate head, a through hole being formed in the mounting member, a bolt unit compatible with the through hole being configured in the handle, an actuator being formed on the push switch, the actuator being connected with the bolt unit and configured to drive the bolt unit to move in or out of the through hole so as to lock or unlock the subordinate head.

5. The anti-theft zipper head of claim 4, wherein the bolt unit comprises a bolt member and a push member, the bolt member being elastically connected to the handle, a bolt compatible with the through hole being formed on the bolt member, the push member being installed on and covering the bolt, the actuator being pushed against the push member.

6. The anti-theft zipper head of claim 5, wherein a spring is disposed at the bottom of the bolt member, the spring being configured to elastically connect the bolt member to the handle.

7. The anti-theft zipper head of claim 1, wherein the handle further comprises a password lock, the password lock being configured to lock or unlock the push switch.

8. An anti-theft zipper head comprising:

a head member, the head member comprising a zipper groove for engaging a zipper; and a handle connected with the head member; wherein:

the head member further comprises an elastic piece, the elastic piece being configured for engaging the zipper and thereby confining the movement of the head member on the zipper, the elastic piece being rotatably disposed in the head member and having a first position of extending into the zipper groove or a second position of being outside of the zipper groove; and the handle comprises a push switch and a password lock, the push switch being configured to control the elastic piece to extend into the zipper groove so as to engage the zipper, or to withdraw from the zipper groove so as to be disengaged with the zipper, the password lock being configured to lock or unlock the push switch, and the push switch is connected with the elastic piece through a cord.

9. The anti-theft zipper head of claim 8, wherein the push switch is a sliding block elastically disposed on the handle and an end of the elastic piece has an inclined surface.

10. The anti-theft zipper head of claim 8 further comprising a subordinate head detachably connected with the handle, a mount member being configured on the subordinate head, a through hole being formed in the mounting member, a bolt unit compatible with the through hole being configured in the handle, an actuator being formed on the push switch, the actuator being connected with the bolt unit and configured to drive the bolt unit to move in or out of the through hole so as to lock or unlock the subordinate head.

11. The anti-theft zipper head of claim 10, wherein the bolt unit comprises a bolt member and a push member, the bolt member being elastically connected to the handle, a bolt compatible with the through hole being formed on the bolt member, the push member being installed on and covering the bolt, the actuator being pushed against the push member.

12. The anti-theft zipper head of claim 11, wherein a spring is disposed at the bottom of the bolt member, the spring being configured to elastically connect the bolt member to the handle.

13. An anti-theft zipper head comprising:

a head member, the head member comprising a zipper groove for engaging a zipper; and a handle connected with the head member; wherein:

the head member further comprises an elastic piece, the elastic piece being rotatably disposed in the head member and having a first position of extending into the zipper groove or a second position of being outside of the zipper groove, and configured for engaging the zipper and thereby confining the movement of the head member on the zipper; and the handle comprises a push switch, the push switch being configured to control the elastic piece to extend into the zipper groove so as to engage the zipper, or to withdraw from the zipper groove so as to be disengaged with the zipper, the push switch being a sliding block elastically disposed on the handle, an end of the elastic piece having an inclined surface, and the push switch is connected with the elastic piece through a cord.

14. The anti-theft zipper head of claim 13 further comprising a subordinate head detachably connected with the handle, a mount member being configured on the subordinate head, a through hole being formed in the mounting member, a bolt unit compatible with the through hole being configured in the handle, an actuator being formed on the push switch, the actuator being connected with the bolt unit and configured to drive the bolt unit to move in or out of the through hole so as to lock or unlock the subordinate head.

15. The anti-theft zipper head of claim 14, wherein the bolt unit comprises a bolt member and a push member, the bolt member being elastically connected to the handle, a bolt compatible with the through hole being formed on the bolt member, the push member being installed on and covering the bolt, the actuator being pushed against the push member.

16. The anti-theft zipper head of claim 15, wherein a spring is disposed at the bottom of the bolt member, the spring being configured to elastically connect the bolt member to the handle.

17. The anti-theft zipper head of claim 13, wherein the handle further comprises a password lock and the push switch is connected with the elastic piece through a cord, the password lock being configured to lock or unlock the push switch.

* * * * *